United States Patent [19]

Yoshioka

[11] Patent Number: 4,729,142

[45] Date of Patent: Mar. 8, 1988

[54] TOOTHBRUSH

[75] Inventor: Larry M. Yoshioka, Rancho Palos Verdes, Calif.

[73] Assignee: Joseph C. Cox, III, Los Angeles, Calif.

[21] Appl. No.: 846,205

[22] Filed: Mar. 31, 1986

[51] Int. Cl.[4] ..... A46B 9/04

[52] U.S. Cl. ..... 15/167.1; 128/62 A

[58] Field of Search ..... 15/167 R, 167 A, 172, 15/176, 110; D4/104–114; 128/62 A

[56] References Cited

U.S. PATENT DOCUMENTS

| | | | |
|---|---|---|---|
| 560,663 | 5/1896 | Wallas | 15/167 R |
| 2,168,964 | 8/1939 | Strasser | 15/167 R |
| 2,273,278 | 2/1942 | Kennedy | 15/167 R |
| 2,592,099 | 4/1952 | Ackerman | 15/167 R X |
| 2,618,801 | 11/1952 | Hibbs | 15/167 R |
| 4,570,282 | 2/1986 | Kaufman et al. | 128/62 A |

FOREIGN PATENT DOCUMENTS

| | | | |
|---|---|---|---|
| 2502918 | 10/1982 | France | 15/167 R |

*Primary Examiner*—Peter Feldman

*Attorney, Agent, or Firm*—Bogucki, Scherlacher, Mok & Roth

[57] ABSTRACT

A toothbrush for improved execution of the modified Bass method of cleaning teeth comprises a handle having a bristle mounting and disposed at a negative angle relative to the principal axis of the handle. In a specific example, a substantially rectangular array of bristle tufts is mounted on the angled end of the handle, the bristle tufts comprising four columns forming eight rows, the columns being substantially equally spaced at the base and the rows being substantially equally spaced. A forward edge grouping of bristle tufts is provided comprising a row of three bristle tufts. The tufts have from 20 to 150 bristles and the bristles are from 5/16" to 9/16" in length. The two outer columns of bristle tufts are angled inwardly at 7° from the vertical and the two center columns of tufts are angled inwardly at 6° from the vertical, to provide greater firmness against the teeth when the handle is rotated than when the handle is reciprocated along the teeth. The two outer bristle tufts of the row of bristle tufts in the forward edge grouping can be angled inwardly at an angle of 6° to 7° from the vertical, the center bristle tuft being substantially vertical.

11 Claims, 9 Drawing Figures

FIG. 1
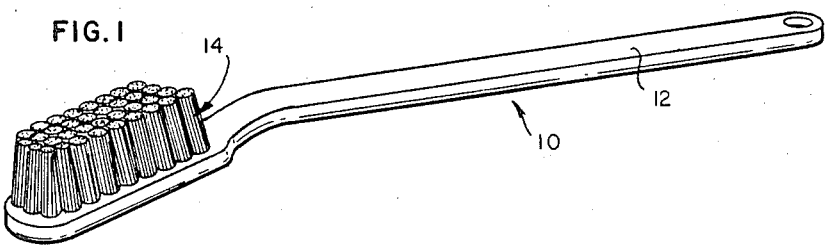
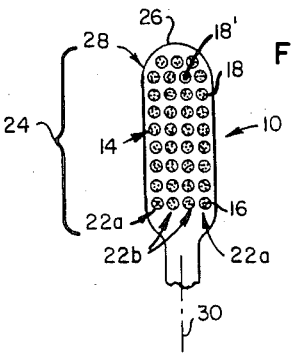
FIG. 2
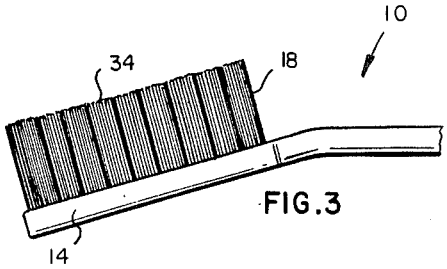
FIG. 3
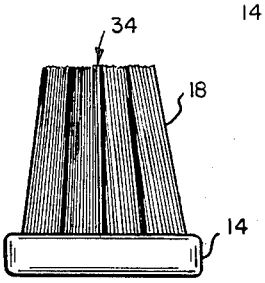
FIG. 5
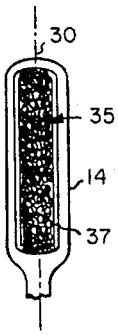
FIG. 6
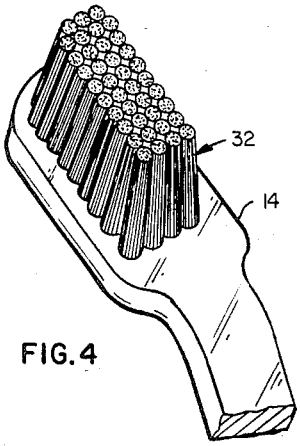
FIG. 4
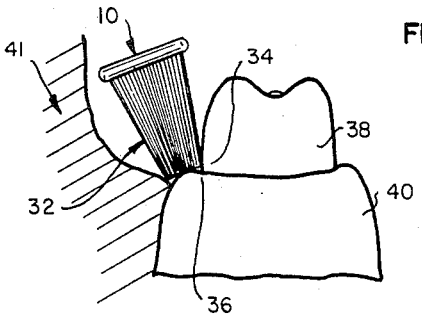
FIG. 7
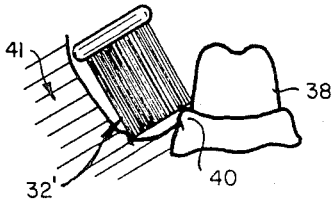
FIG. 8
PRIOR ART
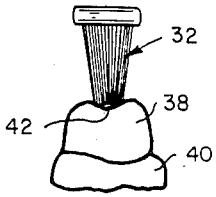
FIG. 9

TOOTHBRUSH

BACKGROUND OF THE INVENTION

This invention relates to toothbrushes, and is particularly concerned with the design of a toothbrush especially adapted for use in the modified Bass method and other approved methods for oral hygiene.

In the modified Bass method for brushing the teeth, the brush is placed in the region of the sulcus, that is the joinder line between the tooth and the gum, and moved horizontally so as to dislodge food particles and other foreign particle matter from that region. The toothbrush is then rotated away from the sulcus toward the occlusal surface of the teeth to flick out particles of foreign matter in the area, and to wipe matter outwardly from between the teeth.

If particles are on the side surfaces of the tooth itself, they can readily be reached by the ordinary toothbrush for removal. Plaque accumulates in the sulcus, which in turn causes caries and periodontal disease. Structurally standard types of toothbrushes do not conform well to the anatomy of the teeth and gum, and therefore are difficult to position or introduce gum and tooth damage. Also, they are often too hard, and many are too difficult to use to teach proper brushing.

Toothbrushes of many shapes and designs have been proposed in the prior art in an attempt to remove particles from tooth crevices. Thus, numerous toothbrushes have been disclosed which have various configurations of angled bristles adapted to form a tapered cross section or an outwardly divergent cross section in the body of the brush. Examples of such prior art toothbrushes are shown in the following patents: U.S. Pat. Nos. 560,663; 1,753,290; 2,004,633; 2,097,987; 2,155,245; 2,168,964; 2,429,740; 2,592,099; 2,618,801; 2,807,820; and 4,081,876. These earlier brushes, however, have been designed either with very limited or highly specialized objectives in mind. They have not considered in interrelated fashion the numerous factors which affect efficient brushing action.

When employing the conventional toothbrushes of the prior art for cleaning the teeth, as by the modified Bass technique, frequent abrasions occur on the hard and soft tissues. The sulcus areas are often not cleaned at all because of the inability of such brushes to effectively negotiate the gingival areas and the anatomical grooves of the teeth. Thus, in many instances the brushes are too large, the tufts are angled incorrectly or flare too much, or the surface area of the bristles, together with the stiffness or softness of the bristles, presents an excessively firm or yielding surface. Fewer but larger bristles provide one type of brushing sensation and action, for example, but this can be changed substantially by varying the number of bristles per tuft, the diameter of the individual bristles or the contact surface area of the brushes. Often when employing conventional toothbrushes in the modified Bass method, which should be carefully practiced, the wrong row of tufts are inserted into the sulcus.

There is therefore a need for a toothbrush which is particularly designed for easy and effective use in dislodging and cleaning particular matter from the junction between the gum and the teeth.

SUMMARY OF THE INVENTION

The toothbrush according to the invention is basically designed such that the bristle tufts have a converging upward taper, with the diameters, number and placement of the bristles being interrelated so as to provide a surface contact area of controlled compression characteristics, narrowness and wear properties.

For this purpose, a toothbrush is provided with a handle having a bristle mounting which is preferably disposed at a negative angle relative to the principal axis of the handle. A plurality of bristles or bristle tufts in a substantially rectangular array are mounted on the angled end of the handle, in the form of spaced columns, the long direction of the array being parallel along the length or center line of the brush. The columns of bristle tufts comprise at least two substantially parallel rows of bristle tufts disposed laterally in the long direction of the brush, the rows being substantially equally spaced from each other. At least the outer columns of bristle tufts or bristles are angled inwardly at an angle no greater than 16° from the vertical. The ends of the bristles terminate in a common plane and provide a closely spaced and cooperative action at the bristles when flexing. The toothbrush bristles are firmer when the brush is rotated about the length of the handle against the teeth of a user than when the handle is reciprocated for lengthwise brushing along the teeth, to facilitate effecting the modified Bass method.

The bristles are mounted in multi-bristle tufts with substantially uniform spacings between the tufts at the base of the array. The width of the mass of bristles at the top of the brush is substantially less than at the base. In preferred practice, the outer columns of the array of bristle tufts are angled inwardly at an inclination of about 7° from the vertical and the inner columns are angled inwardly at an inclination of about 6° to the vertical. Further, for best results, the toothbrush of the invention is provided with an optimum number of columns and lateral rows of bristle tufts, the tufts having an optimum number of bristles of an optimum diameter and length, all as described in greater detail hereinafter.

The converging taper of the invention toothbrush imparts a relatively firm composite flexure response to the brush user while using relatively soft bristles to prevent gum damage. The taper of the brush aids the brush in retaining its form and resilience, and prevents the bristles from exaggerated flaring particularly during rotational movement of the brush. The arrangement of the columns of bristle tufts in straight lateral rows, together with their central convergence, allows greater resilience during rotational movements of the brush while introducing no added resistance during the forward and back motion of the brush. However, the convergence of the bristles provides a greater degree of stiffness in rotational motion of the brush as opposed to horizontal motion, and hence avoids injury to the gums during such horizontal motion. Also, the narrower brush surface in combination with the cooperative flexure properties of the bristle mass provides an adequately firm but still a soft surface for brushing. In addition the brush can readily be positioned in the sulcus regions and on the occlusal surfaces. All of such factors facilitate best use of the modified Bass method.

A feature of the invention is that the action and configuration of the toothbrush render it superior for employment with surface bonding techniques now being widely used for improving the surface appearance and general conformation of teeth. Veneers or shields of plastic or porcelain that are bonded to the surface of a tooth for these purposes are disposed with some spacing above the gingival to avoid irritation. The same is true of plastics which are layered on the tooth in liquid form to provide a protective and decorative coating. The dual problems of penetrating the crevices in the gingival region and avoiding undue abrasion of the protective layer are advantageously confronted by the present invention's combination of relatively soft bristles and narrow, focused brushing contact surface.

BRIEF DESCRIPTION OF THE DRAWINGS

A better understanding of the invention may be had by reference to the following description, taken in conjunction with the accompanying drawings, in which:

FIG. 1 is a perspective view of a toothbrush according to the invention;

FIG. 2 is a plan view of the brush block, showing the arrangement of the bristle tufts in columns and rows;

FIG. 3 is a side view of the brush showing the uniform height of the bristle tufts on the brush block;

FIG. 4 is a perspective view showing the brush face;

FIG. 5 is an essentially schematic illustration showing the angle of inclination of the outer and inner columns of bristle tufts;

FIG. 6 is a plan view of the brush face showing the greater density of the bristles at the top of the brush adjacent the longitudinal center line of the brush;

FIG. 7 illustrates use of the invention toothbrush as a sulcus toothbrush in the modified Bass method;

FIG. 8 illustrates the use of a prior art toothbrush in cleaning the sulcus region; and FIG. 9 illustrates use of the invention toothbrush for cleaning the central groove of the teeth.

DETAILED DESCRIPTION OF THE INVENTION

The toothbrush 10 of the invention shown in FIG. 1 comprises a handle 12 having a brush block 14 including a plurality of bristles connected to the handle at one end, the brush block being disposed at a negative angle, preferably about 2° to about 40°, to the handle. In the present example the angle is approximately 15°. By the term "negative angle" is meant that the brush block 14 is at an angle relative to the longitudinal axis of the handle 12 which shifts the bristle tips away from, rather than toward, the desired contact region. This means that the handle 12 must be angled outwardly to bring the working surface of the brush block 14 flat against the outside surfaces of molars, for example in comparison to a straight toothbrush. However, bristle contact with the less accessible areas is facilitated with this geometry. The brush handle can be made of various materials including plastic, metal, or even wood or pulp products. Preferably, the handle and brush block are formed of plastic materials which are durable, relatively chemically inert, and mass producible.

The width and length of the brush block or head 14 should be sufficient to support the base of the bristles. The brush block 14 should not be so large as to physically impede mobilization of the bristles in tooth areas difficult to clean (i.e. the mandibular retro-molar pad area and the maxillary distal buccal area), or to cause trauma to tissues. Brush blocks which are too small, however, cannot be readily manufactured with the desired bristle tuft pattern and concentration, as described below.

Referring to FIG. 2, illustrating a specific example, mounted in suitably sized holes 16 on the inner surface of the brush block 14 is a number of columns and rows of inwardly angled bristle tufts 18. The hole size for supporting the individual bundles of bristles or bristle tufts 18 on the brush block can vary, but in this example is 0.062 inch.

The bristle tufts 18 mounted in the holes of the brush block are arranged in a substantially rectangular array on the brush block 14. Such array consists of four columns 22 forming eight lateral parallel rows 24, of bristle tufts 18, the columns being substantially equally spaced at the base of the brush block, and the rows being substantially equally spaced at the base. The array also includes, at the forward edge 26 of the brush block, a leading grouping or row 28 of three equally spaced bristle tufts, including two outer bristle tufts 18 and a central bristle tuft 18', the forward edge row 28 being parallel to the rows 24 of the bristle tufts.

It will be noted in FIG. 2 that the long or longitudinal direction of the array of bristle tufts is parallel to the length of the handle. Within the brush block 14, the columns 22 of bristle tufts are substantially parallel at their bases. There are also four rows 24 of bristle tufts, preferably eight rows, the tuft bases of which are substantially parallel and disposed laterally along the long direction of the array.

By using greater numbers of bristle ends in each tuft, but a lesser number of rows (down to 2), the total number of bristle ends in the brush can be kept approximately the same as with a greater number of rows, while also providing other features in accordance with the invention. However, most users are accustomed to certain tuft sizes in conventional toothbrushes and the fabrication advantages are limited.

With bristles of diameters as given below (e.g. 0.007"), the bristle tufts 18 can comprise from 20 to 150 bristle ends each, the optimum number of bristles or bristle ends per tuft being 46. Bristle end quantities substantially greater than 66 per bristle tuft have been found to render the composite too stiff and uncompliant, for most persons, under compressive and flexure forces. Bristle end quantities substantially less than 44 per tuft tend to become distorted prematurely with use as well as tending to make the bristle mass too flexible from the standpoint of the majority of users.

The diameter of the bristles is preferably 0.007" in this example. Bristles approaching 0.012" are individually too hard and stiff and hence are abrasive to hard and soft tissues, as well as providing a composite rigidity. Bristles of 0.006" or less, with the given range of bristle ends per tuft, provide a brush which is too soft and fails to hold its shape with repeated use.

Bristles of less than 0.006" in diameter are seldom used with present day toothbrushes, but smaller diameters can be utilized, down to as small as 0.003", if the number of bristle ends per tuft is increased and the number of rows is reduced, say to two. A brush having bristle diameters of 0.004" can, for example, be constructed in accordance with the invention if the tufts have 300 bristles per tuft with only two rows angled inwardly at 8°.

As illustrated in FIG. 3, the height of the bristle tufts 18 above the brush block 14, along the length of the brush, is substantially uniform, so that the top of the brush, which forms the effective brushing area, is substantially planar, as also noted in FIG. 1. The height or length of the bristles can range from 5/16" to 9/16", the optimum being 7/16". Heights greater than 9/16" render it difficult to place the brush and bristles on the occlusal surface of the molar areas, especially for persons having small mouths. Bristle heights less than 5/16" tend to make cleaning on the gingival surfaces difficult, since the handle tends to strike the incisor teeth before the bristles can reach the cervical areas.

In conjunction with the features noted above, an additional important feature of the toothbrush of the invention is the inward angling or convergence of the bristle tufts 18 from the brush block 14, as noted in FIGS. 1, 4 and 5. The inward taper or angle of the bristle tufts 18 from the base should be between 2° and 16°, from the vertical, with the upper ends of the bristles being in contact or forming a dense mass. Consequently the toothbrush bristles have a greater composite firmness against the teeth when the handle is rotated than when the handle is reciprocated to brush lengthwise along the teeth of a user, in practicing the modified Bass technique. As indicated particularly in FIG. 5, a preferred angle of the two outer columns **22*a* of bristle tufts is 7° from the vertical, and that of the two inner columns 22*b* is 6° from the vertical. This creates convergence of the bristle tufts towards the longitudinal center line 30 at the top 34 of the resulting brush 32, viewing FIG. 6. It also provides greater density and firmness at 35 adjacent the center line 30, while the lateral borders at 37 are slightly less firm, even though like bristles are used throughout. Thus, the mass of bristles is substantially narrower at the top of the brush 32 than at the base. Inward angles of the bristle tufts 18** greater than 16° become too stiff and less compliant at the lateral borders. Angles less than 2° lose central density and form.

The two outer bristle tufts 18 in the forward edge row 28 preferably are also angled inwardly at an angle no greater than 16°, e.g. 6° to 7°, from the vertical, while the central bristle tuft 18' of the forward edge row can be substantially vertical.

It will be noted in the side view of FIG. 3 that the bristle tufts 18 are in this direction perpendicular to the longitudinal center line or axis 30 of the brush handle. However, as noted above and seen in FIG. 5, the tufts are angled inwardly in planes which are transverse to the brush handle.

The arrangement of the array of bristle tufts with respect to the columns and rows of bristle tufts 18, in conjunction with the inward angling of the bristle tufts, as described above, provides virtually ideal convergence of the central columns **22*b* of fiber tufts. This establishes central tip density giving a combination of composite flexure properties and with lateral row suppleness, with the even spacing between the parallel rows 24 of fiber tufts providing mutual support against rotation. On the other hand, columns of tufts with staggered rows would tend to provide less support. The forward edge row 28** at the tip of the brush can comprise less than three bristle tufts, e.g., two inwardly angled bristle tufts, but this results in more flaring, especially when cleaning the sulci of the molars on the cheek side.

As noted in FIG. 7, the converging array of angled bristle tufts 18 in the toothbrush 10 of the invention, wherein the width of the mass of bristle at the top of the brush is substantially less than at the base, permits the top or outer end of the brush to be readily inserted into the sulcus (also called crevice or pocket) 36 between the tooth 38 and gum 40 in the region of the sulcus. With the combination of adequately soft bristles but composite flexure in response to compression, the modified Bass technique can be practiced with less abrasion or irritation of the gums, as can be seen by comparing the view of FIG. 7 with that of FIG. 8, which depicts usage of a conventional brush 32'. The lateral borders of the brush are more supple, which helps in sulcular cleaning and inter proximal cleaning employing the modified Bass technique.

FIGS. 7 and 8 also depict the relative advantages of applicants' construction in use within confined regions of the mouth, particularly at or close to the back molars. The inside of the cheek 41 (vestibule or buccal surface) often merges closely into the gum near the sulcus 36. Thus, as in FIG. 8, the upper edge of the conventional brush 32' must be positioned at the sulcus 36, causing the other side edge to abrade against the cheek 41. It is even more difficult to attempt to brush around the corner of the back molar. Other factors of size and shape also have been taken into account, such as the fact that the average spacing between upper and lower teeth when the mouth is opened is 45 mm for the female and 55 mm for the male. Bristles cannot be too long or the brush cannot be manipulated through the available orifice, or too short because the bristle ends will then not properly engage into less accessible crevices, such as the sulcus of the mandibular molars on the linqual side without the handle contacting the incisal edge of the lower front incisors.

The arrangement of the column bases in straight transverse rows and the central convergence of the tufts allows greater resilience in rotational movements of the brush while the forward and back motion provides no added resistance. Added resistance in the forward-back motion would tend to cause gingival recession and root abrasion, which of course is undesirable.

As illustrated in FIG. 9, the brush arrangement of the invention also provides a narrow working brush face which facilitates cleaning the central groove 42 of the biting surfaces of the teeth 38. The composite firmness of the brush also aids in dislodging particles on the tooth surfaces.

Toothbrushes in accordance with the invention are particularly useful for cleaning when teeth have received bonded facings for decorative and protective reasons. There are two types of such facings, these being plastic (usually acrylic) protective coatings applied in liquid form and plastic or porcelain shells or veneers shaped to fit the tooth surface and bonded on with adhesive. These applied surfaces are less abrasion resistant than tooth enamel, in varying degrees, so that the relatively soft individual bristles used in the present invention are of importance in reducing wear when contact is made. Moreover, the narrow and limited contact area presented by the bristles enables superior penetration into crevicular areas whose susceptibility to caries is heightened by the application of bonded elements. The crevice below the top of the free gingival, where the gum curves down to be tangent to the tooth, is normally about 3 mm in a healthy person. The bonded material is normally kept away from this space, to avoid irritation to the gingival, although some sub-gingival fillings may be used where decay has taken place in the gingival region. Cleaning of the crevices in the gingival region is very important, although brushing wear on the adjacent bonded layers, particularly acrylics, must be minimized. The toothbrush of the invention is particularly able to negotiate these crevices without requiring high pressures or unduly abrading adjacent surfaces.

From the foregoing, it is seen that the invention provides an improved, effective and durable toothbrush, particularly designed for cleaning the teeth employing the modified Bass method, as well as other techniques such as vertical and orbital motions.

Since various changes and modifications of the invention will occur to and can be made readily by those skilled in the art without departing from the invention concept, the invention is not to be taken as limited excet by the scope of the appended claims.

What is claimed is:

1. A toothbrush for improved execution of the modified Bass method of brushing teeth comprising:

a plurality of bristles in a substantially rectangular array of spaced columns on a handle, the bristles being mounted in multi-bristle tufts with substantially uniform spacings thereof in the array, the long direction of the array being parallel to the length of the handle, there being at least two substantially parallel columns of bristles disposed laterally on each side along the long direction to define at least inner and outer columns on each side, wherein the bristles terminate in a common plane to define a brushing surface and the outer and inner columns of bristles are angled inwardly at an angle of no greater than 16° from the vertical, the width of the mass of bristles at the top being substantially less than at the base, such that the toothbrush bristles are firmer when rotated about the length of the handle against the teeth of a user than when brushed lengthwise against the teeth, and sufficiently dense to provide a cooperative flexure when subjected to compression.

2. The toothbrush as set forth in claim 1, wherein the bristle tufts comprise from 20 to 150 bristle ends each, the outer columns have an inclination of about 7° and the inner columns have an inclination of about 6°, and wherein the bristles are from 5/16" to 9/16" in length and about 0.007" in diameter.

3. The toothbrush as set forth in claim 2, comprising four columns of bristle tufts forming eight lateral parallel rows, and a forward edge grouping of bristle tufts.

4. The toothbrush as set forth in claim 3, said forward edge grouping of bristle tufts comprising a row of at least two bristle tufts substantially parallel to the other rows of bristle tufts, and angled inwardly at an angle no greater than 16° from the vertical, and wherein there are approximately 66 bristles per tuft.

5. A toothbrush for improved execution of the modified Bass method of cleaning teeth by penetrating crevices such as the joinder between the gum and tooth, moving horizontally and then rotating away from the gum to dislodge matter, comprising:

a handle having a bristle mounting and disposed at a negative angle relative to the principal axis of the handle; and a substantially rectangular array of bristle tufts mounted on the angled end of the handle, wherein the bristles terminate in a substantially common plane to define a brushing surface, the bristle tufts comprising four columns forming eight rows, the columns being substantially equally spaced at the base and the rows being substantially equally spaced at the base, and a forward edge grouping comprising a row of three bristle tufts, the tufts having approximately 46 bristles of 0.007" diameter each, and the bristles being approximately 7/16" long, the two outer columns of tufts being angled inwardly at 7° from the vertical and the two center columns of tufts being angled inwardly at 6° from the vertical.

6. The toothbrush as set forth in claim 5, the two outer bristle tufts in the row of the forward edge grouping being angled inwardly at an angle of 6° to 7°, from the vertical.

7. A toothbrush comprising:

a handle having a bristle mounting end; and an array of columns and rows of bristle tufts mounted on the bristle mounting end of the handle, the bristles being from 5/16"–9/16" in height and from 0.003"–0.012" in diameter, with from 20–150 bristle ends per tuft, wherein the outer and inner columns are angled inwardly at from 2°–16° from the vertical to provide greater firmness against the teeth when the handle is rotated than when the handle is reciprocated along the teeth, and wherein the bristle tufts converge along the longitudinal center line of the brush to terminate in a substantially common plane and provide greater density and firmness adjacent the center line, while the lateral borders are less dense.

8. The toothbrush as set forth in claim 7, employing four equally spaced parallel columns of bristle tufts forming eight parallel rows, the rows being substantially equally spaced.

9. The toothbrush as set forth in claim 8, including a forward edge grouping comprising a row of three equally spaced bristle tufts, parallel to the other rows of bristle tufts.

10. The toothbrush as set forth in claim 9, the bristle tufts having approximately 46 bristle ends of 0.007" in diameter each and the bristles being approximately 7/16" long, the outer columns of tufts being angled inwardly at 7° from the vertical and the two inner columns being angled inwardly at 6° from the vertical.

11. The toothbrush as set forth in claim 10, the two outer bristle tufts of the row of bristle tufts in the forward edge grouping being angled inwardly at an angle of 6° to 7° from the vertical, and the center bristle tuft being substantially vertical.

* * * * *